US006494758B1

(12) United States Patent
Natarajan et al.

(10) Patent No.: US 6,494,758 B1
(45) Date of Patent: Dec. 17, 2002

(54) PROCESS OF FORMING METAL/FERRITE LAMINATED MAGNET

(75) Inventors: Govindarajan Natarajan, Pleasant Valley; John U. Knickerbocker, Hopewell Junction; Srinivasa S. N. Reddy, Lagrangeville; Rao V. Vallabhaneni, Hopewell Junction, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/364,842

(22) Filed: Jul. 30, 1999

(51) Int. Cl.[7] ..... H01J 9/24; H01J 29/07
(52) U.S. Cl. ..... 445/37; 419/8
(58) Field of Search ..... 445/37; 419/8; 313/422

(56) References Cited

U.S. PATENT DOCUMENTS 4,023,057 A 5/1977 Meckling
4,138,236 A 2/1979 Haberey
4,540,500 A 9/1985 Torii et al.
5,857,883 A * 1/1999 Knickerbocker et al. ..... 445/23
5,932,498 A * 8/1999 Beeteson et al. ..... 252/62.59
5,986,395 A * 11/1999 Knickerbocker et al. ... 313/431
6,008,573 A * 12/1999 Beeteson et al. ..... 313/422
6,181,059 B1 * 1/2001 Beeteson ..... 313/422
6,246,165 B1 * 6/2001 Beeteson ..... 313/422
6,264,885 B1 * 7/2001 Knickerbocker et al. ..... 419/26
6,317,106 B1 * 11/2001 Beeteson et al. ..... 313/422

FOREIGN PATENT DOCUMENTS

JP 60093742 5/1985

OTHER PUBLICATIONS

UK9–95–019 UK Patent Application; Application No. 9517465.2; Filed Aug. 25, 1995.
Uk9–96–036 UK Patent Application; Application No. 08/823,669; Filed Mar. 24, 1997.

* cited by examiner

*Primary Examiner*—Kenneth J. Ramsey
(74) *Attorney, Agent, or Firm*—Margaret A. Pepper

(57) ABSTRACT

The present invention relates generally to a new metal/ceramic laminate magnet and process thereof. More particularly, the invention encompasses a new process for fabrication of a large area laminate magnet with a significant number of holes, integrated metal plate(s) and electrodes for electron and electron beam control. The present invention also relates to a magnetic matrix display and electron beam source and methods of manufacture thereof.

31 Claims, 2 Drawing Sheets

PROCESS OF FORMING METAL/FERRITE LAMINATED MAGNET

FIELD OF THE INVENTION

The present invention relates generally to a new metal/ceramic laminate with discretely distributed magnets with through-holes and process thereof. More particularly, the invention encompasses a new process for fabrication of a large area ceramic laminate with discretely distributed magnets with integrated metal plate(s) and electrodes for electron and electron beam control. The present invention also relates to a magnetic matrix display (MMD) structure and methods of manufacture thereof.

BACKGROUND OF THE INVENTION

A magnetic matrix display is particularly, although not exclusively, useful in display applications, especially flat panel display applications. Such flat panel display applications include television receivers, visual display units for computers, especially, although not exclusively, portable and/or desktop computers, personal organizers, communications equipment, wall monitor, portable game unit, virtual reality visors and the like. Flat panel display devices based on a magnetic matrix electron beam source hereinafter may be referred to as Magnetic Matrix Displays (MMD).

Conventional flat panel displays, such as liquid crystal display panels, and field emission displays, provide one display technology. However, these conventional flat panel displays are complicated and costly to manufacture, because they involve a relatively high level of semiconductor fabrication, delicate materials, and high tolerance requirements.

U.S. patent application Ser. No. 08/695,856, filed on Aug. 9, 1996, entitled "ELECTRON SOURCE", which also corresponds to U.K. Patent Application Serial No. 2304981, assigned to the assignee of the instant Patent Application and the disclosure of which is incorporated herein by reference, discloses a magnetic matrix electron source and methods of manufacture thereof. Also disclosed is the application of the magnetic matrix electron source in display applications, such as, for example, flat panel display, displays for television receivers, visual display units for computers, to name a few. Also disclosed is a magnetic matrix display having a cathode for emitting electrons, a permanent magnet with a two dimensional array of channels extending between opposite poles of the magnet, the direction of magnetization being from the surface facing the cathode to the opposing surface. The magnet generates, in each channel, a magnetic field for directing electrons from the cathode means into an electron beam. The display also has a screen for receiving the electron beam from each channel. The screen has a phosphor coating facing the side of the magnet remote from the cathode, the phosphor coating comprising a plurality of pixels each corresponding to a different channel. There are grid electrode means disposed between the cathode means and the magnet for controlling the flow of electrons from the cathode means into each channel. The two dimensional array of channels are regularly spaced on an X-Y grid. The magnet area is large compared with its thickness. The flat panel display devices based on a magnetic matrix electron source is referred to as MMD (Magnetic Matrix Display).

The permanent magnet is used to form substantially linear, high intensity fields in the channels or magnetic apertures for the purpose of collimating the electrons passing through the aperture. The permanent magnet is insulating, or at most, has a small conductivity, so as to allow a field gradient along the length of the aperture. The placement of the beam so formed, on the phosphor coating, is largely dependent on the physical location of the apertures in the permanent magnet.

In operation, these electron beams are directed at a phosphor screen and collision of the electron beam with the phosphor results in light output, the intensity being proportional to the incident beam current (for a fixed final anode voltage). For color displays, three different colored phosphors (such as red, green and blue) are used and color is obtained by selective mixing of these three primary colors.

For accurate color reproduction, the location of the electron beams on the appropriate colored phosphor is essential.

Some degree of error may be tolerated by using "black matrix" to separate the different phosphors. This material acts to delimit individual phosphor colors and also enhances the contrast ratio of the displayed image by making the display faceplate appear darker. However, if the electron beam is misplaced relative to the phosphor, initially the light output from the phosphor is reduced (due to loss of beam current to the black matrix) and this will be visible as a luminance non-uniformity. If the beam is subject to a more severe placement error, it may stray onto a different colored phosphor to that for which it was intended and start to produce visible quantities of light output. Thus the misplaced electron beam is actually producing the wrong light output color. This is called a purity error and is a most undesirable display artifact. For a 0.3 mm pixel, typical phosphor widths are 67 $\mu$m with 33 $\mu$m black matrix between them.

It will be apparent that a very precise alignment is required between the magnet used to form the electron beams and the glass plate used to carry the phosphors that receive the electron beams. Further, this precise alignment must be maintained over a range of different operating conditions (high and low brightness, variable ambient temperature etc).

A number of other magnet characteristics are also important when considering application for a display, such as, for example:

1. It is generally accepted that the displayed image is formed by a regular array of pixels. These pixels are conventionally placed on a square or rectangular grid. In order to retain compatibility with graphics adaptors the magnet must thus present the electron beams on such an array.
2. In operation, the spacing between the grids used for bias and modulation of the electron beam and the electron source determines the current carried in the electron beam. Variations of this spacing will lead to variations in beam current and so to changes in light output from the phosphor screen. Hence it is a requirement that the magnet, which is used as a carrier for these bias and modulation grids, maintain a known spacing to the electron source. To avoid constructional difficulties, the magnet should be flat.
3. The display will be subject to mechanical forces, especially during shipment. The magnet must retain structural integrity over the allowable range of stresses it may encounter. A commonly accepted level is an equivalent acceleration of about 30G (294 $ms^{-2}$).

One further requirement is that since the magnet is to be used within the display, which is evacuated, it should not contain any organic components which may be released over the life of the display, so degrading the quality of vacuum or poisoning the cathode.

Finally, the magnet is magnetized in the direction of the apertures, that is the poles correspond to the faces of the magnet.

The manufacture of such a magnet that satisfies the above conditions is not possible by the use of previously known manufacturing methods. Certainly a magnet (ferrite, for example) of the desired size without apertures is readily obtainable but the presence of the apertures causes some problems.

If the apertures in the magnet are to be formed after the ferrite plate has been sintered, either laser or mechanical drilling may be used. However, the sintered ferrite is a very hard material and forming the apertures by this technique will be a costly and lengthy process—unsuitable for a manufacturing process.

Holes could be formed in the ferrite at the green-sheet stage before sintering by known punching/drilling methods typical of multi-layer ceramics for microelectronics applications. However, during sintering a number of problems would be anticipated, such as, for example:

The magnet plate will be subject to uneven shrinkage leading to the holes "moving"—an unequal radial displacement from their nominal positions;

The magnet itself is likely to "bow" such that it forms a section of a large diameter sphere;

Cracking is likely to occur between adjacent apertures due to the apertures acting as stress concentrators; or If, to obtain the desired aperture length, multiple thin sheets are stacked on top of one another, misalignment may occur in stacking which could lead to no "line of sight" through the apertures.

A further problem is that ferrite is a hard but not tough material and the presence of the apertures significantly reduces the mechanical strength of the plate. Thus, during shipment when large shocks may be encountered, complete mechanical failure of the magnet is a distinct possibility.

U.S. Pat. No. 4,138,236 discloses a method of bonding hard and/or soft magnetic ferrite parts with an oxide glass. The oxide glass may be applied prior to or after pre-firing or main firing. Finally, the ferrite parts are fused at temperatures in excess of the glass softening point.

U.S. Pat. No. 4,540,500 discloses a low temperature sinterable oxide magnetic material prepared by adding 0.1 to 5.0 percent by weight of glass to ferrite. In some situations, the sintering temperature can be reduced to about 1,000° C. or less.

U.S. Pat. No. 4,023,057 discloses a compound magnet for a motor stator having a laminated structure that includes thin, flexible magnets made from permanently magnetizable particles, such as barium ferrite, that are embedded in a flexible matrix, such as rubber. Various laminated arrangements are contemplated for producing more intense magnetic fields and thin metal spacers are used in most laminated structures to collapse the respective fields of the flexible magnetic components to increase the flux density at the resultant poles and to orient the permanent magnetic fields in the magnetic circuit of the motor.

Published Japanese Patent Application No. JP60093742 discloses a display having a focus electrode with a conductive magnetic body and a sputtered metal coating on one surface of the magnet body. The conductivity is required for the focusing electrode to perform its function. The coating is sputtered and so is a thin coating, not substantially adding to the mechanical structure of the magnet. Each of the holes in the magnet has a number of electron beams passing through it.

U.S. patent application Ser. No. 08/823,669, filed on Mar. 24, 1997, entitled "MAGNET AND METHOD FOR MANUFACTURING A MAGNET", assigned to the assignee of the instant Patent Application and the disclosure of which is incorporated herein by reference, discloses a magnet-photosensitive glass composite and methods thereof.

U.S. Pat. No. 5,857,883, (Knickerbocker et al.), entitled "Method of Forming Perforated Metal/Ferrite Laminated Magnet", assigned to the assignee of the instant Patent Application and the disclosure of which is incorporated herein by reference, discloses a process for fabrication of a large area laminate magnet with a significant number of perforated holes, integrated metal plate(s) and electrodes for electron and electron beam control.

PURPOSES AND SUMMARY OF THE INVENTION

The invention is a novel structure and process for metal/ceramic laminate with discretely and orderly distributed magnets with through-holes.

Therefore, one purpose of this invention is to provide a structure and a process that will form metal/ceramic laminate with discretely distributed magnets.

Another purpose of this invention is to provide a structure and a process that will provide metal/ceramic laminate with discretely and orderly distributed magnets with through-holes.

Yet another purpose of this invention is to use the metal/ceramic laminate as a mask to create an image on at least one glass plate to form multi-phosphors (red, green, blue) material which receives an electron beam to create a display.

Still another purpose of this invention is to provide a structure through which one or more collimated beam(s) of electrons can be formed using the ceramic/magnetic laminate.

Yet another purpose of this invention is to provide a structure that can be used with any electron sensitive process.

Still yet another purpose of the invention is to provide a laminated metal/ceramic laminate with discretely distributed magnets that has a plurality of openings for guiding electrons and/or electron beams.

Therefore, in one aspect this invention comprises a process of forming unsintered metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and thereby forming said unsintered metal/ferrite laminate magnet.

In another aspect this invention comprises a process of forming unsintered metal/ferrite laminate magnet, comprising:

(a) forming at least one opening in a metal sheet having a first surface and a second surface, (b) securing at least one dielectric layer to said first surface of said metal sheet, (c) forming a second hole with first hole as a guide, (d) filling said at least one opening in said metal sheet and said dielectric layer with at least one composite magnetic material, (e) forming at least one opening through said ferritic material and said dielectric layer, such that at least a portion of said opening overlaps at least a portion of said opening in said metal sheet, and thereby forming said unsintered metal/ferrite laminate magnet.

In still another aspect this invention comprises a process of forming metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and sintering the same to form said metal/ferrite laminate magnet.

In yet another aspect this invention comprises a display device comprising, at least one cathode means and at least one metal/ferrite laminate magnet, wherein said magnet has at least one opening which extends between opposite poles of said magnet, creating at least one magnetic channel, wherein said magnetic channel allows the flow of electrons received from said cathode means into at least one electron beam towards at least one target.

In still another aspect this invention comprises a display device comprising, a screen for receiving electrons from an electron source, said screen having a phosphor coating facing said side of a magnet remote from said cathode; and means for supplying control signals to a grid electrode means and an anode means to selectively control flow of electrons from said cathode to said phosphor coating via at least one magnetic channel, and thereby producing an image on said screen.

In still yet another aspect this invention comprises a display device comprising, a screen for receiving electrons from at least one electron source, said screen having a phosphor coating facing said side of a magnet remote from said cathode, said phosphor coating comprising a plurality of groups of different phosphors, said groups being arranged in a repetitive pattern, each group corresponding to a different channel; means for supplying control signals to said grid electrode means and said anode means to selectively control flow of electrons from said cathode to said phosphor coating via said channel; and deflection means for supplying deflection signals to said anode means to sequentially address electrons emerging from said channel to different ones of said phosphors for said phosphor coating thereby to produce a color image on said screen.

In yet another aspect this invention comprises an apparatus comprising, at least one cathode means, at least one metal/ferrite laminate magnet, wherein said magnet has at least one magnetic channel extending between opposite poles of said magnet, wherein each magnetic channel allows the flow of electrons received from said cathode means into an electron beam, grid electrode means disposed between said cathode means and said magnet for controlling flow of electrons from said cathode means into said magnetic channel, and, anode means remote from said cathode for accelerating electrons through said magnetic channel.

In yet another aspect this invention comprises a process of forming sintered metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and (e) sintering said metal sheet and said ferritic material, and thereby forming said sintered metal/ferrite laminate magnet.

BRIEF DESCRIPTION OF THE DRAWINGS

The features of the invention believed to be novel and the elements characteristic of the invention are set forth with particularity in the appended claims. The drawings are for illustration purposes only and are not drawn to scale. Furthermore, like numbers represent like features in the drawings. The invention itself, however, both as to organization and method of operation, may best be understood by reference to the detailed description which follows taken in conjunction with the accompanying drawings in which:

DETAILED DESCRIPTION OF THE INVENTION

Figure 1:
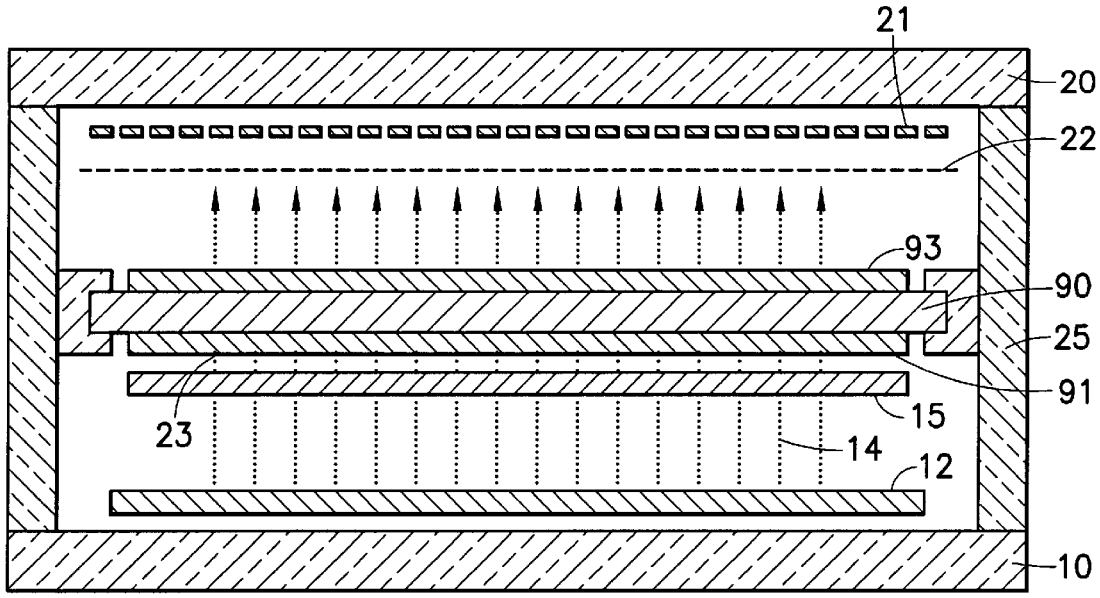
FIG. 1, illustrates a preferred embodiment of this invention where a metal/ceramic laminate with discretely distributed magnets direct at least one electron beam from a cathode to a display panel.

In accordance with the present invention, there is provided an electron source comprising at least one cathode means and at least one ceramic laminate with discretely distributed magnets. The magnets are perforated by at least one channel extending between opposite poles of the magnet, wherein each channel in a magnet that can direct or guide electrons received from the cathode means into an electron beam towards a target with no possible overlap.

In a preferred embodiment of the present invention, the electron source comprises grid electrode means disposed between the cathode means and the discrete magnets for controlling flow of electrons from the cathode means into the magnetic channels.

The magnetic channels are preferably disposed in the magnets in a two dimensional array of rows and columns. However, a person skilled in the art could also customize the dimensional array.

Preferably, the grid electrode means comprise a plurality of parallel row conductors and a plurality of parallel column conductors arranged orthogonally to, and insulated from, the row conductors, each channel being located at a different intersection of a row conductor and a column conductor.

The grid electrode means may be disposed on the surface of the cathode means facing the magnet. Alternatively, the grid electrode means may be disposed on the surface of the magnet facing the cathode means.

The cathode means may comprise a cold emission device such as a field emission device. Alternatively, the cathode means may comprise a photocathode. In some embodiments of the present invention, the cathode may comprise a thermionic emission device.

In a particularly preferred embodiment of the invention, each channel may have a cross-section which varies in shape and/or area along its length.

In a preferred embodiment of the present invention, each channel may be tapered, the end of the channel having the largest surface area facing the cathode means.

The laminate with discretely distributed magnets preferably comprises ferrite. In some embodiments of the present invention, the magnet may comprise a ceramic material. In preferred embodiments of the present invention, the magnet may also comprise a binder. The binder may be organic or inorganic. Preferably, the binder comprises an inorganic glass composite containing glass forming oxides for optimized properties in fabrication and use.

In the preferred embodiment of the present invention, the channel is circular in cross-section. In other embodiments of the present invention, the cross-section of the channel could be selected from a group comprising, triangular, rectangular, polygonal, to name a few. The corners and edges of each channel could also be chamfered.

The present invention extends to display devices and a computer system comprising: memory means; data transfer means for transferring data to and from the memory means; processor means for processing data stored in the memory means; and a display device comprising the electron source as hereinbefore described for displaying data processed by the processor means.

It will further be appreciated that the present invention extends to a print-head comprising an electron source as hereinbefore described. Still further, it will be appreciated that the present invention extends to document processing apparatus comprising such a print-head, together with means for supplying data to the print-head to produce a printed record in dependence on the data.

The present invention in yet another aspect is a triode device comprising: cathode means; a laminate with discretely distributed magnets perforated by at least a channel extending between opposite poles of the magnet wherein each channel forms electrons received from the cathode means into an electron beam; grid electrode means disposed between the cathode means and the magnet for controlling flow of electrons from the cathode means into the channels; and, anode means disposed on the surface of the magnet remote from the cathode for accelerating electrons through the channels towards the glass plate containing phosphors.

The present invention from still another aspect is a process for making an electron beam collimator, comprising: forming perforated metal plates, perforated greensheets of dielectric and ferrite containing compositions, forming metal electrode conductors and composite magnetic structure to produce a laminate with discretely distributed magnets with desired characteristics.

The process may comprise mixing the ferrite with a binder prior to forming the discretely distributed magnets. Preferably, the binder comprises glass particles.

The process may comprise depositing anode means on a perforated face of the magnets.

Preferably, the process comprises depositing control grid means on the face of the laminate with discretely distributed magnets remote from the face carrying the anode means.

At least one of the steps of depositing the anode means and the steps of depositing the control grid means may comprise photolithography. Alternatively, plating, screen printing or decal transfer may be used for depositing anode means and control grid means.

The present invention from still another aspect is a process for making a display device comprising: making an electron source according to the process hereinbefore described; positioning a phosphor coated screen adjacent to the face of the magnet carrying the anode means; and, evacuating spaces between the cathode means and between the magnet and the magnet and the screen.

The present invention from yet another aspect is a process for addressing pixels of a display screen having a plurality of pixels, each pixel having successively first, second, and third sub-pixels in line, the process comprising: generating a plurality of electron beams, each electron beam corresponding to a different one of the pixels; and, deflecting each electron beam to repetitively address the sub-pixels of the corresponding pixel in the sequence second pixel, first pixel, second pixel, third pixel.

Referring now to the figures, such as, FIG. 1, a color magnetic matrix display (MMD) of the present invention comprises: a first or lower plate 10, such as, a glass plate 10, carrying at least one cathode 12, and a second or upper plate 20, such as, a glass plate 20, carrying at least one coating of at least one phosphor pixel or dots or stripes 21. It is preferred that the stripes 21, are sequentially arranged red, green and blue phosphor stripes 21, facing the cathode 12. The phosphor stripes 21, are made from preferably high voltage phosphors. At least one anode layer 22, is disposed on or adjacent to the phosphor coating 21.

At least one composite magnetic plate or sheet 90, with discretely distributed magnets is disposed between the plates 10 and 20. The composite magnetic sheet 90, has a first or lower surface 91, and an upper or second surface 93, and is perforated by a two dimension matrix of perforation or "pixel wells" 23. Electron beams 14, are channeled through the "pixel wells" 23. At least one bias 15, which is preferably near or on the first surface 91, can be used to channel the electrons in the electron beam 14.

At least one electrically conductive metal 15 and/or 22, could be secured to at least one surface of the sintered or unsintered metal/ferrite laminate magnet 90.

At least one anode 22, could also be secured to the sintered or unsintered metal/ferrite laminate magnet 90. The anode 22, could be formed using a process selected from a group comprising photolithography, screen printing, decal transfer, plating, or adhesive patterning, followed by dry deposition of at least one electrically conductive medium.

At least one control grid 15, could also be secured to the sintered or unsintered metal/ferrite laminate magnet 90. The control grid 15, could be formed using a process selected from a group comprising photolithography, screen printing, decal transfer, plating, or adhesive patterning, followed by dry deposition of at least one electrically conductive medium.

Figure 2:
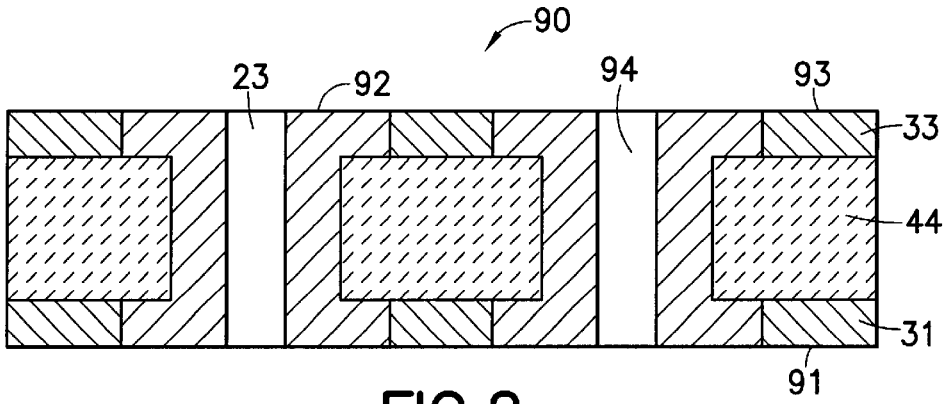
FIG. 2, illustrates a detailed view of the inventive structure of the metal/ceramic laminate with discretely distributed magnets with at least one hole per magnet wherein the hole extends between the poles of the magnet.

FIG. 2, shows a cross-sectional detailed view of the inventive structure of the metal/ceramic laminate 90, with at least one hole or opening per discrete magnet. The laminate 90, is built with a first or bottom metal plate 31, having surface 91, a second or top metal plate 33, having surface 93, at least one dielectric layer 44, and at least one discrete magnet 92. The magnet 92, has at least one pixel well 23, having inner wall 94, that extend from one end of the magnetic pole to the opposite end of the magnet, which is the boundary of the holes 23, and the electrons from the electron beam 14, are channeled through the hole 23, defined by the magnetic inner wall 94. In a typical 17 inches or 21 inches diagonal display, the MMD laminate 90, may contain couple of millions of holes 23, and hence couple of millions of magnets 92. It is preferred that there be a hole per pixel or a magnet per pixel. The magnets 92, are discrete and are distributed in the laminate 90, which is made from the metals 31 and 33 and the dielectric 44. The laminate 90, is very flat and is manufactured with compatible materials that can be co-sintered. For example, the metal 31 and 33, can be stainless steel, the dielectric layer 44, could be a ceramic layer 44, which can be alumina or glass ceramic, and the magnet 92, can be a ferrite or ferrite with glass, to name a few.

The metal sheet 30, could be used as a mask to form at least one layer of phosphor on at least one screen 21. The laminate magnet 90, could also be used as a mask to form at least one layer of phosphor on at least one screen 21. For some applications a display device could be made by positioning a phosphor coated screen 21, adjacent the face of the magnet carrying the anode means 22, and, evacuating spaces between the electron source 12, and between the magnet 92, and the screen 21.

The opening 23 or 32, in the composite magnetic material 90, could be formed by partially sintering the ferritic material and using a pressurized impinging medium to open the opening 23 or 32. The cross-section of the opening 23 or 32, could be selected from a group comprising circular cross-section, polygonal cross-section, triangular cross-section, rectangular cross-section, to name a few.

FIGS. 3–8, illustrate a preferred process for the manufacture of the inventive composite magnetic plate or sheet 90, comprising at least one metal/ceramic laminate with magnets.

Figure 3:
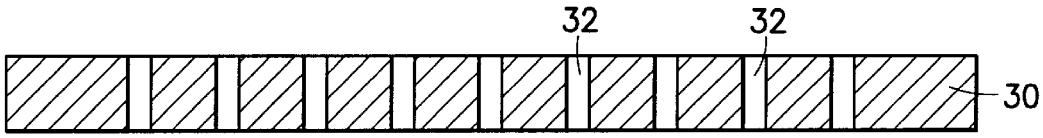
FIGS. 3–8, illustrate a preferred process to manufacture the metal/ceramic laminate with discretely distributed magnets of this invention.

FIG. 3, shows at least one rolled metal sheet 30, which is preferably capable of withstanding oxidizing atmospheres of up to about 1,000° C. At least one photo resist is applied onto this metal sheet 30, which is subsequently exposed and developed to produce a pattern of holes or openings 32. These holes 32, can be made by methods well known in the art, such as, by etching with at least one etchant that attacks the metal sheet 30.

The desired array of holes 32, made in the metal sheet 30, can also be inspected to ensure that all the holes 32, are present, and that the dimensional and positional tolerances of the holes 32, are met. Hole diameter with a tolerance of about 0.3 mil and hole to hole pitch with a tolerance of about 0.2 mil is achievable by this technique.

For some applications the exposed surface of the metal sheet 30, may have to be prepared to enhance the adhesion between the metal sheet 30, and the subsequent layer, such as, a dielectric layer. This could be accomplished by the deposition of or formation of selected adhesion promoting metals or oxides on one or both surfaces of the metal sheet 30. However, one could also use at least one suitable adhesive to secure a dielectric layer to the metal sheet 30.

Figure 4:
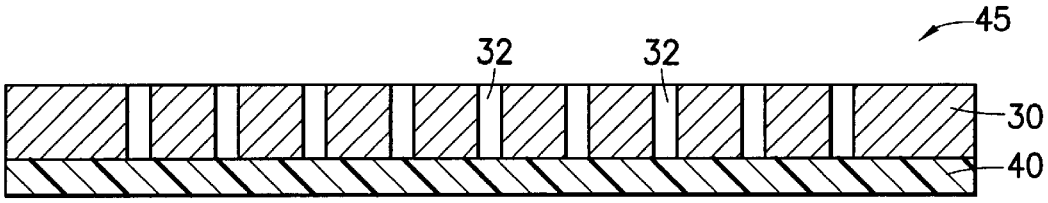

As shown in FIG. 4, a sub-laminate structure 45, is formed by combining the etched metal sheet 30, with holes 32, to at least one thin dielectric layer 40, such as, a green sheet 40, on at least one exposed surface to form a primary "green" sub-laminate structure 45. It is preferred that the sub-laminate structure 45, is formed in such a way so that there is no movement between the various layers, such as, between the metal sheet 30, with holes 32, and the at least one dielectric layer 40. This can be done by the simultaneous application of heat and/or pressure to all components or layers of the sub-laminate structure 45, or by adhesively bonding the layers to the metal sheet 30. It should be appreciated that the at least one dielectric layer 40, can be on one side as shown or on both sides of the metal sheet 30, as needed.

The dielectric layer or sheet 40, of FIG. 4, can be formed in a number of ways, such as, on at least one exposed surface of the metal sheet 30, one could form at least one cast sheet 40. This could be done by combining a glass powder, organic binders, solvents and vehicles to produce a slurry capable of being cast into at least one thin dielectric sheet 40. The technology used to produce the thin dielectric sheet 40, is similar to the one used to prepare conventional multilayer ceramic greensheets. After drying, the cast sheet 40, could be cut to the proper size to form a cast dielectric layer 40, onto at least one surface of the metal sheet 30.

After the primary unsintered sub-laminate structure 45, has been formed, holes or openings are produced in the dielectric green sheet(s) 40, using the pre-existing hole 32, in the metal sheet 30, as a guide. The holes formed in the green dielectric layer 40, of the sub-laminate structure 45, can be made by a myriad of techniques, such as, mechanical, laser beam, electron beam, techniques known to those skilled in the art.

The insulator layer 40, could be formed by mixing at least one dielectric material to form a dielectric slurry; one would then mix, cast and dry the dielectric slurry into a dielectric green sheet; and then the dielectric green sheet could be blanked to form the dielectric layer 40.

For some applications the insulator layer 40, could be formed by mixing at least one dielectric material to form a dielectric slurry, paste or powder, and wherein the dielectric mix could be deposited onto the metal sheet 30, using at least one method selected from a group comprising spraying, screening, dry-pressing, to name a few.

The insulator layer 40, could also be formed by mixing the dielectric material to form a dielectric slurry, paste or powder, and wherein the dielectric slurry could be integrated onto the metal sheet 30, using at least one method selected from a group comprising spraying, casting, screening, dry-pressing, to name a few.

The insulator layer 40, could be secured to the surface of the metal sheet 30, by application of heat and/or pressure. The insulator layer 40, could also be secured to the surface of the metal sheet 30, by using at least one adhesive material.

Figure 5:
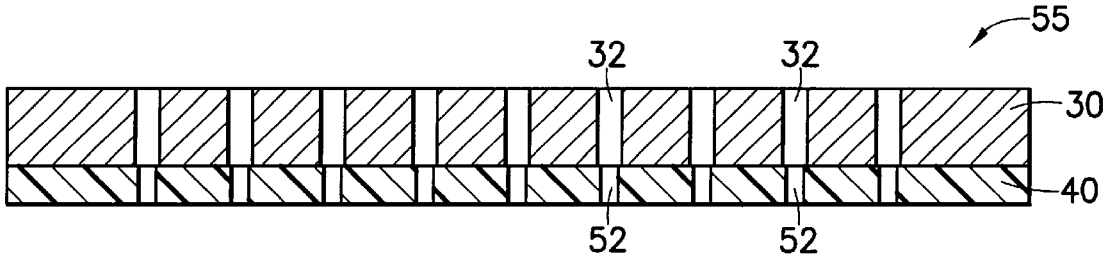

FIG. 5, shows that the primary unsintered sub-laminate structure 45, has now been perforated with holes or openings 52, that have been produced in the dielectric green sheet 40, creating a punched dielectric green sheet 40, that combines with the metal sheet 30, to form a perforated primary green laminate 55. It is preferred that the array of holes 32, in the metal sheet 30, are slightly larger than the array of holes 52, in the dielectric layer 40, to help facilitate subsequent hole formation and also to enhance the reliability of ultimate desired structure.

The hole 32, in the metal sheet 30, could be used to form at least one corresponding hole 52, in subsequent components, and wherein all of the correspondingly formed holes are preferably held in registration with the hole 32, in the metal sheet 30.

Figure 6:
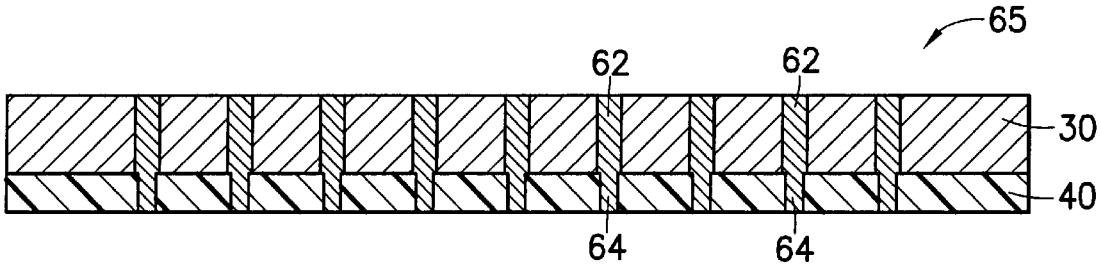

FIG. 6, illustrates the next step in building the inventive structure that is shown in FIG. 2. The holes 32, in the metal sheet 30, and the holes 52, in the dielectric layer 40, of the laminate 55, shown in FIG. 5, are now filled with at least one material 62, in the opening 32, in metal sheet 30, or material 64, in the opening 52, in the dielectric layer 40. This filling could be done by methods well known in the art, such as, by screening. It is preferred that the material 62 and/or 64, is made of permanent magnetic material, such as, a ferrite. The resulting multi-layered laminate structure 65, as shown in FIG. 6, with magnetic material 62 and 64, in the holes of the metal sheet 30 and dielectric layer 40. The magnetic material 62 and 64, are preferably of the same composition and concentration, however, for some applications the composition and concentration of the magnetic material 62 and 64, could be different from each other.

The composite magnetic material 62 and/or 64, used in this invention could also be formed by mixing ferritic material with glass particles, organic binders and solvents to form a ferritic paste, slurry or powder; and applying the ferritic mix to form the ferritic material 62 and/or 64.

For some applications the composite magnetic material 62 and/or 64, could be formed by mixing ferritic material with glass particles, organic binders and solvents to form a ferritic paste, slurry or powder; casting and drying the ferritic paste, slurry or powder, into a ferritic green sheet; and blanking the ferritic green sheet to form the ferritic material 62 and/or 64.

It has been found that the composite magnetic material 62 and/or 64, could also be formed by mixing ferritic material with glass particles, organic binders and solvents to form a ferritic slurry, paste or powder, and wherein the ferritic mix is deposited onto the metal sheet 30, using at least one method selected from the group comprising spraying, screening, extruding, to name a few.

The composite magnetic material 62 and/or 64, could also be formed by mixing ferritic material with glass particles, organic binders and solvents to form a ferritic slurry, paste or powder, and wherein the ferritic mix would be integrated into the metal sheet 30, using at least one method selected from the group comprising spraying, screening, extruding, etc.

The composite magnetic material 62 and/or 64, could be filled into the opening 32, in the metal sheet 30, by application of heat and/or pressure.

Figure 7:
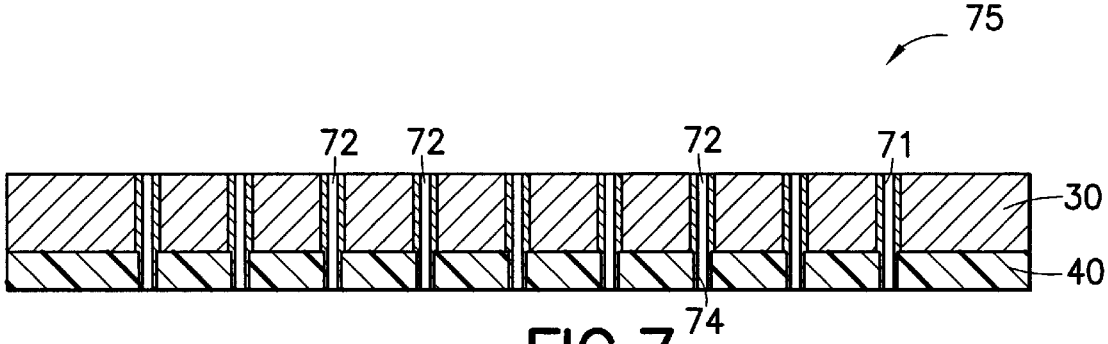

The unsintered multi-layered laminate structure 75, as shown in FIG. 7, is obtained by forming through holes 72, in the magnetic material 62 and 64, having an 5 inner wall 71, of magnetic material 74. However, it should be understood that for some applications, the metal sheet 30, having a magnetic material 74, with inner wall 71, could be formed separately, and the dielectric material 40, having a magnetic material 74, with inner wall 71, could be formed separately, and then they could be joined to form the unsintered multi-layered laminate structure 75. Of course care must be made to make sure that the openings 72, are aligned in order for the electrons to pass through the inner wall 71, during subsequent operation.

For some applications at least two of the sintered or unsintered metal/ferrite laminate magnet 90, could be secured to each other such that the metal sheet sandwiches the dielectric material 40.

Figure 8:
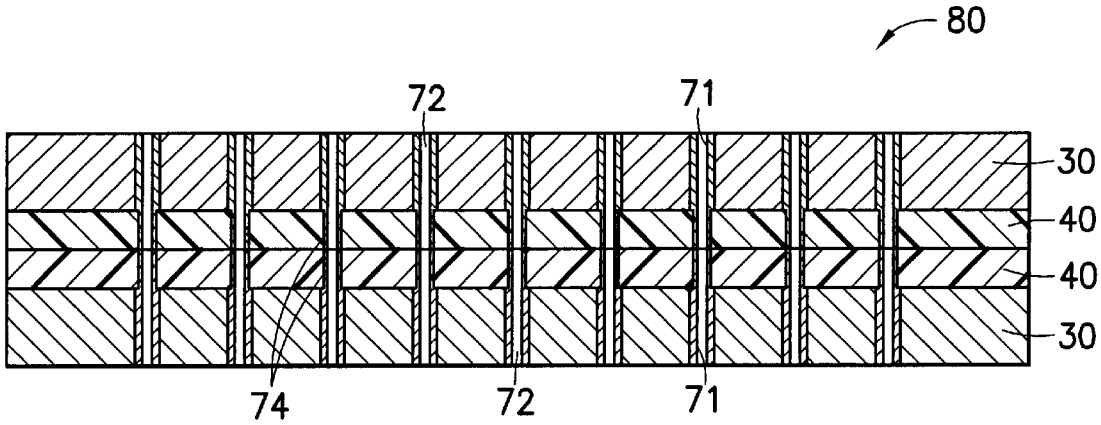

FIG. 8 illustrates the sintered multi-layered magnetic laminate 80, which in this case is the result of securing multiple laminates 75, and subsequently sintering them. As shown, the top and bottom metal sheets 30, sandwich at least one dielectric layer 40. The holes 72, now stretch from one surface of the first metal sheet 30, to the other surface of the second metal sheet 30, having an inner wall 71, of magnetic material 74. However, subsequent to this step, one could also build metal electrodes on the top and bottom surfaces of the laminate 80. The electrode on either top and/or bottom surface of the sintered laminate 80, could be made by any conventional thin film technology.

It should be noted that a plurality of perforated primary unsintered laminate structures 75, may be combined into a secondary unsintered laminate structure 80, by the reapplication of heat and/or pressure to the components or by the use of an organic adhesive. In this step care must be taken to ensure the alignment of the holes 72, in the various substructures.

An alternate method of forming metal/ceramic laminate 90, with discretely distributed magnets 92, could be done by forming at least one opening 32, in a metal sheet 30, and securing at least one non-magnetic dielectric layer 40, to the metal sheet 30. One could then form at least one opening 52, in the dielectric layer 40, such as, by punching. The opening 52, corresponds to at least one opening 32, in the secured metal sheet 30, to obtain a laminate structure like 55. One could then build a multilaminate structure consisting of at least two structures like 55, with dielectric layers 40, secured to each other with all holes aligned, and sintering the metal/dielectric layer assembly with holes to full densification. Subsequently, one could fill the holes in the multilaminate structure with at least one permanent magnet material, preferably a ferrite in at least one opening in the metal/dielectric layers, extending through top and bottom surfaces of the sintered multi-laminate structure. At this point at least one opening is formed in the at least one permanent magnet material. Now, the metal/dielectric layers with the screened permanent magnet material is sintered, and thereby forming the metal/ceramic laminate with at least one discretely distributed magnet(s) as shown in FIG. 2.

For some applications the metal sheet 30, could act as an electron sink.

For some applications the metal sheet 30, could act as a heat spreader.

The metal sheet 30, could be used to act as a stiffener to prevent any distortion of the laminate magnet 90.

In another alternative method, one could build the structure 90, as shown in FIG. 2, by using the conventional thin film approach like CVD (chemical vapor deposition) to form the permanent magnet material with at least one opening.

An yet another alternate method of forming metal/ceramic laminate 90, with discretely distributed magnets 92, could be done by forming at least one opening 32, in a metal sheet 30, and securing at least one non-magnetic dielectric layer 40, to the metal sheet 30. One could then form at least one opening 52, in the dielectric layer 40, such as, by punching. The opening 52, corresponds to at least one opening 32, in the secured metal sheet 30, to obtain a laminate structure like 55. One could then build a multi-laminate structure consisting of at least two structures like 55, with dielectric layers 40, secured to each other with all holes aligned, and sintering the metal/dielectric layer assembly with holes to full densification. Subsequently, one could deposit the permanent magnet material by CVD techniques on the side walls of the sintered openings 52, to obtain the structure as shown in FIG. 2.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A process of forming unsintered metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and thereby forming said unsintered metal/ferrite laminate magnet.

2. The process of claim 1, wherein said at least one opening in said metal sheet is formed by the application of at least one photoresist on said metal sheet, exposing and developing said photoresist to form a pattern of holes, and using said pattern of holes to subsequently etch said metal sheet to form said at least one opening in said metal sheet.

3. The process of claim 1, wherein said at least one opening in said metal sheet is formed by a group consisting of laser beam, electron beam or mechanical means.

4. The process of claim 1, wherein said at least one composite magnetic material is formed by mixing ferritic material with glass particles, organic binders and solvents to form a ferritic paste, slurry or powder; and applying said ferritic mix to form said at least one ferritic material.

5. The process of claim 1, wherein said at least one composite magnetic material is formed by mixing ferritic material with glass particles, organic binders and solvents to form a ferritic paste, slurry or powder; casting and drying said ferritic paste, slurry or powder, into a ferritic green sheet; and blanking said ferritic green sheet to form said at least one ferritic material.

6. The process of claim 1, wherein said at least one composite magnetic material is formed by mixing ferritic material with glass particles, organic binders and solvents to form a ferritic slurry, paste or powder, and wherein said ferritic mix is deposited onto said metal sheet using at least one method selected from the group consisting of spraying, screening and extruding.

7. The process of claim 1, wherein said at least one composite magnetic material is formed by mixing ferritic material with glass particles, organic binders and solvents to form a ferritic slurry, paste or powder, and wherein said ferritic mix is integrated into said metal sheet using at least one method selected from the group consisting of spraying, screening and extruding.

8. The process of claim 1, wherein said at least one insulator layer is formed by mixing at least one dielectric material to form a dielectric slurry; mixing, casting and drying said dielectric slurry, into a dielectric green sheet; and blanking said dielectric green sheet to form said at least one dielectric layer.

9. The process of claim 1, wherein said at least one insulator layer is formed by mixing at least one dielectric material to form a dielectric slurry, paste or powder, and wherein said dielectric mix is deposited onto said metal sheet using at least one method selected from a group consisting of spraying, screening and dry-pressing.

10. The process of claim 1, wherein said at least one insulator layer is formed by mixing dielectric material to form a dielectric slurry, paste or powder, and wherein said dielectric slurry is integrated onto said metal sheet using at least one method selected from a group consisting of spraying, casting, screening and dry-pressing.

11. The process of claim 1, wherein said at least one composite magnetic material is filled into said at least one opening in said metal sheet by application of heat and/or pressure.

12. The process of claim 1, wherein said at least one insulator layer is secured to said first surface of said metal sheet by application of heat and/or pressure.

13. The process of claim 1, wherein said at least one insulator layer is secured to said first surface of said metal sheet by using at least one adhesive material.

14. The process of claim 1, wherein at least one electrically conductive metal is secured to a first surface of said unsintered metal/ferrite laminate magnet.

15. The process of claim 1, wherein at least one anode is secured to said unsintered metal/ferrite laminate magnet.

16. The process of claim 15, wherein said at least one anode is formed using a process selected from a group consisting of photolithography, screen printing, decal transfer, plating, or adhesive patterning, followed by dry deposition of at least one electrically conductive medium.

17. The process of claim 1, wherein at least one control grid is secured to said unsintered metal/ferrite laminate magnet.

18. The process of claim 17, wherein said at least one control grid is formed using a process selected from a group consisting of photolithography, screen printing, decal transfer, plating, or adhesive patterning, followed by dry deposition of at least one electrically conductive medium.

19. The process of claim 1, wherein cross-section of said at least one opening is selected from a group consisting of circular cross-section, polygonal cross-section, triangular cross-section or rectangular cross-section.

20. The process of claim 1, wherein said opening in said composite magnetic material is formed by partially sintering said ferritic material and using a pressurized impinging medium to open said at least one opening.

21. The process of claim 1, wherein at least two of said unsintered metal/ferrite laminate magnet are secured to each other such that said metal sheet sandwiches said dielectric material.

22. The process of claim 1, wherein said metal sheet acts as an electron sink.

23. The process of claim 1, wherein said metal sheet acts as a heat spreader.

24. The process of claim 1, wherein said metal sheet acts as a stiffener to prevent any distortion of said laminate magnet.

25. The process of claim 1, wherein said metal sheet is used as a mask to form at least one layer of phosphor on at least one screen.

26. The process of claim 1, wherein said laminate magnet is used as a mask to form at least one layer of phosphor on at least one screen.

27. The process of claim 1, wherein said at least one hole in said metal sheet is used to form at least one corresponding hole in subsequent components, and wherein all of said correspondingly formed holes are held in registration with said hole in said metal sheet.

28. A process for making a display device comprising, making an electron source according to said process claimed in claim 1, positioning a phosphor coated screen adjacent said face of said magnet carrying an anode means, and, evacuating spaces between said electron source and between said magnet and said screen.

29. A process of forming unsintered metal/ferrite laminate magnet, comprising:

(a) forming at least one opening in a metal sheet having a first surface and a second surface, (b) securing at least one dielectric layer to said first surface of said metal sheet, (c) forming a second hole with first hole as a guide, (d) filling said at least one opening in said metal sheet and said dielectric layer with at least one composite magnetic material, (e) forming at least one opening through said ferritic material and said dielectric layer, such that at least a portion of said opening overlaps at least a portion of said opening in said metal sheet, and thereby forming said unsintered metal/ferrite laminate magnet.

30. A process of forming metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and sintering the same to form said metal/ferrite laminate magnet.

31. A process of forming sintered metal/ferrite laminate magnet, comprising:

(a) forming at least one opening in a metal sheet having a first surface and a second surface, (b) securing at least one dielectric layer to said first surface of said metal sheet, (c) filling said at least one opening in said metal sheet with at least one ferritic material, (d) forming at least one opening through said ferritic material and said dielectric layer, such that at least a portion of said opening overlaps at least a portion of said opening in said metal sheet, and (e) sintering said metal sheet and said ferritic material, and thereby forming said sintered metal/ferrite laminate magnet.

* * * * *